United States Patent [19]

Amano et al.

[11] 3,953,692

[45] Apr. 27, 1976

[54] PRESSURE RESPONSIVE SWITCH FOR CONVERTING PRESSURE VARIATIONS TO ELECTRICAL VARIATIONS

[75] Inventors: Matsuo Amano; Seiko Suzuki; Sigeyuki Kobori, all of Hatachi; Ichiro Kimura, Mito, all of Japan

[73] Assignee: Hitachi, Ltd., Japan

[22] Filed: July 9, 1974

[21] Appl. No.: 486,744

[30] Foreign Application Priority Data

July 13, 1973 Japan ..... 48-78427

[52] U.S. Cl. ..... 200/83 P; 200/83 S

[51] Int. Cl.[2] ..... H01H 35/34

[58] Field of Search ..... 200/83 B, 83 P, 83 S, 200/DIG. 66, DIG. 88, 67 A, 67 D, 67 DA, 249, 250, 251, 286, 290, 333

[56] References Cited

UNITED STATES PATENTS

| | | | |
|---|---|---|---|
| 2,503,594 | 4/1950 | Phelps | 200/83 S |
| 2,579,717 | 12/1951 | Wood | 200/83 S |
| 2,722,580 | 11/1955 | Hasselhorn | 200/83 S |
| 3,177,313 | 4/1965 | Klimak | 200/83 P |
| 3,378,656 | 4/1968 | Johnson | 200/83 P |
| 3,594,521 | 7/1971 | Roll | 200/83 P |

*Primary Examiner*—Gerald P. Tolin
*Attorney, Agent, or Firm*—Craig & Antonelli

[57] ABSTRACT

A pressure responsive switch performing switching operation for converting pressure variations into electric variations is disclosed in which the actuating pressure of a snap switching member is adjusted by changing the contact pressure between a pressure applied member and the snap switching member which is in contact with the pressure-applied member. The gap between the break contact of the pressure responsive switch is adjusted thereby to adjust the difference between the pressure between the make contact of the switch when it is closed and the pressure between the break contact of the same when it is closed.

23 Claims, 7 Drawing Figures

PRESSURE RESPONSIVE SWITCH FOR CONVERTING PRESSURE VARIATIONS TO ELECTRICAL VARIATIONS

The present invention relates to a pressure responsive switch used as a component or element of a safety device or annunciator for performing switching operations to convert pressure variations into electric variations.

A pressure responsive switch recently proposed is provided with a snap system separately from a switch means. For example, the switch means is separate from a snapping pressure-applied diaphragm or from a pressure-applied diaphragm and a snap spring. Another method proposed includes an ordinary diaphragm and a snap diaphragm with a contact gap of about 0.2 mm or less.

If the displacement or contact gap of the snap diaphragm of these pressure responsive switches is enlarged, the plastic strain of the diaphragm is increased, resulting in increased variations and decreased yield of products, that is, the rate of the products above standard relative to the whole products. On the other hand, too small a displacement or contact gap of the snap diaphragm is likely to cause the burning of the contacts. Thus a pressure responsive switch requires a proper displacement of the snap diaphragm or a proper gap between the contacts.

It is difficult, however, to maintain a uniform displacement of the snap diaphragm by snapping it under a predetermined pressure, leading to a low yield rate. Also, the fact that the diaphragm itself is snapped causes a short service life of the switch.

It is accordingly an object of the present invention to provide a pressure responsive switch with a high yield and long service life which performs switching operations to convert pressure variations into electric variations.

Another object of the invention is to provide a pressure responsive switch the contact of which does not burn even when it is made and broken with a large current.

Still another object of the invention is to provide a pressure responsive switch which is capable of performing switching operations under any desired pressure.

A further object of the invention is to provide a pressure responsive switch in which the difference between the pressure between the make contact of the switch when it is closed and the pressure between the break contact of the same when it is closed can be easily adjusted.

According to one aspect of the invention, a switch base is screwed into a hollow case and a snap spring member is fixed at its one end to a part of the switch base. The snap spring member has a movable contact at its other end for contacting or being detached from an ON contact and OFF contact provided on the switch base. The switch member is adapted to be brought into contact, directly, or indirectly through an insulating member, with a pressure-applied member which is displaced upon application of pressure to be detected. Also, the position of the switch base relative to the hollow case is adapted to be changed.

According to another aspect of the invention, the OFF contact on the switch base is movable with respect to the switch base so as to enable adjustment of the gap with the break provided on the snap spring member.

The above and other objects, features and advantages will be made by the detailed description taken in conjunction with the accompanying drawings, in which;

FIG. 15 is an elevational sectional view showing the essential parts of the pressure responsive switch of another embodiment of the invention;

Figure 1:
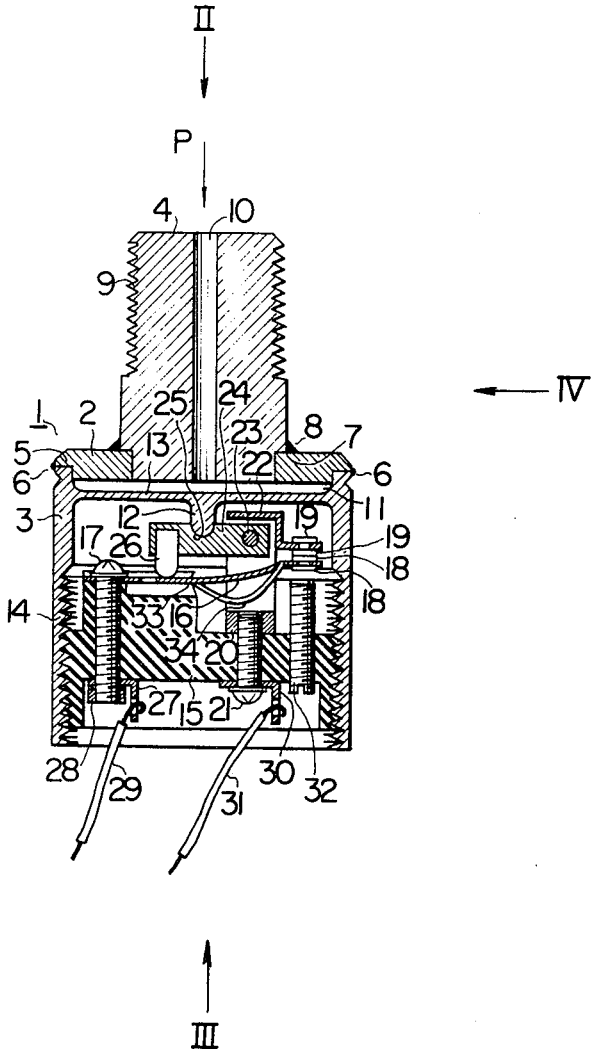
FIG. 1 is an elevational sectional view showing the essential parts of the pressure responsive switch according to an embodiment of the invention.
Figure 2:
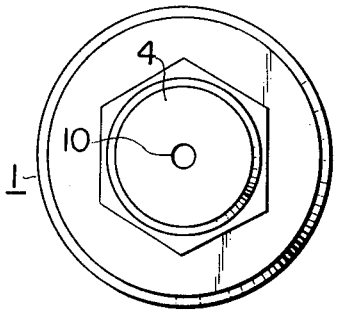
FIG. 2 is a plan view of the pressure responsive switch of FIG. 1 as viewed from the direction of the arrow II.
Figure 3:
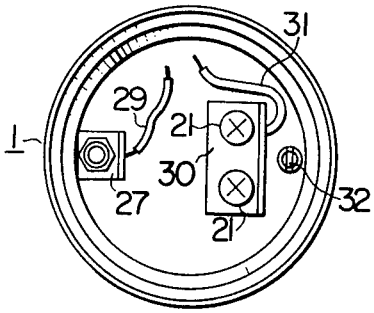
FIG. 3 is a bottom view of the pressure responsive switch of FIG. 1 as viewed from the direction of the arrow III.
Figure 4:
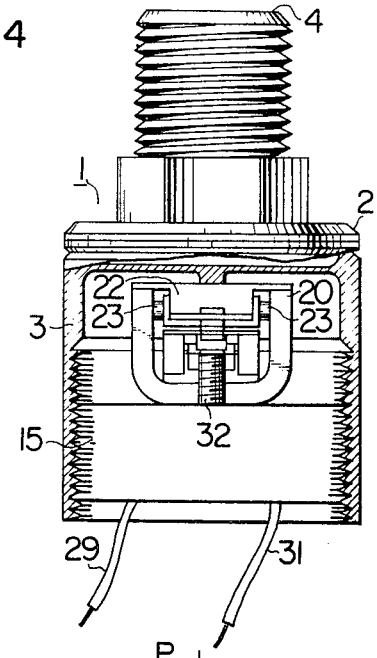
FIG. 4 is a partially broken away side view of the pressure responsive switch of FIG. 1 as viewed from the direction of the arrow IV.

Referring to FIGS. 1, 2, 3 and 4, an embodiment of a pressure responsive switch 1 according to the present invention, comprises a covering 2 and a hollow case 3 both of which are made of such a material as stainless steel. A joint 4 made of brass or the like is fixed to the covering 2. The covering 2 is coupled with the case 3 at a joint section 5 by means of a Heliarc welding 6 or the like, while on the other hand the covering 2 is coupled with the joint 4 at a joint section 7 by means of silver solder 8 or the like. The joint 4 is provided with a male screw 9 and a pressure introducing hole 10. The pressure introducing hole 10 communicates with a pressure chamber 11 and provides an inlet port for introducing pressure P to be detected. The hollow case 3 is provided with a pressure applied member 13 with a protrusion 12 and a female screw 14 into which a switch base 15 made of an insulating material such as phenol resin is screwed to be engaged with the hollow base 3. A snap spring member 16 made of such a material as beryllium copper is fastened to the switch base 15 by means of a screw 17. An end of the snap spring member 16 has an electrical contact 18 (hereinafter referred to as a movable contact) fixedly supported thereon, which movable contact, as shown in FIG. 1, is so arranged as to be brought into contact with and away from a fixed contact 19 hereinafter referred to as an ON contact. A support member 20 made of electrically conductive material is fixed on the switch base 15 with screws 21. A supporting plate 22 having an ON contact 19 is fastened on the support member 20 by spot welding or the like. A supporting shaft 23 is secured to part of the support member 20, so that an end of a displacement amplifying plate 24 is rotatably supported on the supporting shaft 23. Part of the displacement amplyfying plate 24 is formed with a recess 25 with a cone-shaped section which is in contact with protrusion 12 formed in the vicinity of the center of the pressre-applied member 13, while a contact rod 26 made of an insulating material such a phenol resin is supported on the other end of the displacement amplifying plate 24. The contact rod 26 is in contact with the snap spring member 16.

Alternatively, the pressure applied member 18 may be arranged in such a manner that the displacement of the pressure applied member 13 is directly transmitted to the snap spring member 16. However, in such a case given above, the displacement transmission point or the contact point between the protrusion 12 of the pressure applied member 13 and the snap spring member 16 is likely to be varied for each product. In other words, variations in the contact point between the protrusion 12 of the pressure applied member 13 and the snap spring member 16 may result from variations in the screwing engagement between the switch base 15 and the hollow case 3 or variations in the manner in which the snap spring member 16 is mounted on the switch base 15. To solve such a problem, in the embodiment under consideration, the acting point through which the displacement is transmitted to the snap ring member 16 is intended to be fixed as illustrated in FIG. 1, For this purpose, the supporting member 20 fixed on the switch base 15 rotatably supports the displacement amplifying plate 24 part of which is provided with a contact rod 26 in contact with the snap spring member 16, thus allowing only the precision on the side of the switch base 15 to be taken care of. Also, in view of the fact that the protrusion 12 of the pressure applied member 13 is adapted to be in contact with the recess 25 with a cone-shaped section formed in the displacement amplifying plate 24, variations in both the switch base 15 and the protrusion 12 can be absorbed by the contact point.

A terminal 27 is fixed to the screw 17 by a nut 28, and a lead-wire 29 is attached to the terminal 27. On the other hand, a lead wire 31 is connected to the screw 21 through a terminal 30. A screw 32 serves as an OFF contact which cuts off conduction between the lead wire 29 and the lead wire 31 when it is contacted by the movable contact 18. The OFF contact 32 is movable as relative to the switch base 15 by way of the screw engagement therebetween, so that the gap between the movable contact 18 and the OFF contact 32 can be adjusted as desired.

The operation of the pressure responsive switch according to the present invention will be explained below.

When the pressure P to be detected is introduced into the pressure chamber 11 through the pressure introducing hole 10, the pressure-applied member 13 is displaced downward in accordance with the magnitude of the pressure P and this displacement is magnified by the leverage with the supporting shaft 23 as a fulcrum, with the result that the contact rod 26 supported on the displacement amplifying plate 24 swings counterclockwise around the supporting shaft 23 with the increase in the pressure P. The snap spring member 16 is displaced downward and as soon as it goes below a point 33, the spring force of a compression spring 34 of the snap spring member 16 causes the movable contact 18 thus far pressed against the ON contact 19 to snap toward the OFF contact 32. At the same time, the compression spring 34 which has thus far urged the snap spring 16 upward urges the same downward, and therefore the contact 18 is pressed against the OFF contact 32 by the snap spring member 16 displaced downward, thus cutting off the conduction between the lead wires 29 and 31. In like manner, when the pressure P is decreased, the contact rod 26 and the snap spring member 16 are displaced up in such a manner that the movable contact 18 is detached from the OFF contact 32 and quickly snaps into contact with the ON contact 19, thereby causing conduction between lead wires 29 and 31.

Explanation will be made now of the setting of the response of the pressure responsive switch according to the invention to the pressure P to be detected.

The response of the switch to the pressure P is set by adjusting the screwing engagement between the male screw of the switch base 15 and the female screw 14 of the hollow case 3 by rotating the switch base 15. More in detail, if the switch base 15 is displaced upward by screwing into the hollow case 3, the snap spring member 16 can effect the on-off operation under lower pressure. When the switch base 15 is displaced downward, by contrast, a higher pressure is required for the snap spring member 16 to effect the on-off operation. There is a difference between the pressure required for the movable contact 18 to come off the ON contact 19 and to come into contact with the OFF contact 32 and the pressure required for the movable contact 18 to come off the OFF contact 32 and to come into contact with the ON contact 19. This pressure difference which is determined depending on the design of the pressure applied member 13 and the snap spring member 16 is referred to hereinafter as "differential". The OFF contact 32 is constructed so that the gap between the movable contact 18 and the ON contact 19 may be adjusted thereby to regulate the differential. In this way, the present invention provides a pressure responsive switch in which the response thereof can be set at a desired level and the differential can be adjusted very easily.

In a conventional pressure responsive switch, the response setting requires the decomposition of the whole construction and further it is impossible to adjust the differential because it is given by a snap diaphragm. The conventional method of adjustment of differential depends on a snap diaphragm resulting in a disadvantage that variations in the diaphragm lead to variations in pressure responsive switches with considerably decreased yield.

As will be noted from the above description, the pressure responsive switch according to the present invention differs from the conventional one in the point that the former has switch means taking advantage of snap action and permits such a high compressive force of the snap spring that a relatively large current can be turned on and off. Also, the easy adjustment of the response setting and the capability of the adjusting of the differential makes possible the high-yield manufacture of pressure responsive switches with a simple construction at low cost. Further, the lack of snap action in the pressure applied member permits a long life thereof by appropriately controlling the stress level thereof. Furthermore, the service life of the snap spring is sufficiently long as to endure 100 thousand to 200 thousand operations.

Other embodiments of the invention will be explained with reference to FIG. 5 and FIG. 6. In the drawings, the identical or equivalent components or elements are denoted by the same reference numerals as those used in FIG. 1.

Figure 5:
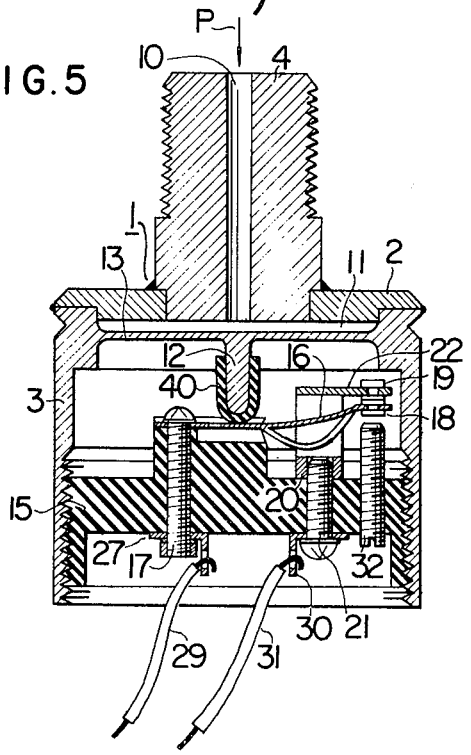

In the pressure responsive switch shown in FIG. 5, the displacement of the pressure applied member 13 itself causes the protrution 12 thereof to press the snap spring 16. The protrusion 12 is covered with a covering 40 of an insulating material such as phenol resin for insulating the pressure applied member 13 from the snap spring member 16. When the pressure P is applied through the pressure introducing hole 10 to the pressure chamber 11, the corresponding displacement of the pressure applied member 13 is transmitted through the protrusion 12 and the insulating member 40 to the snap spring member 16 thereby to snap the movable contact 18 provided at the end of the snap spring member 16 into contact with the OFF contact 32. The operation of the other components or elements is identical with that of the embodiment of FIG. 1 and will not be described here.

Figure 6:
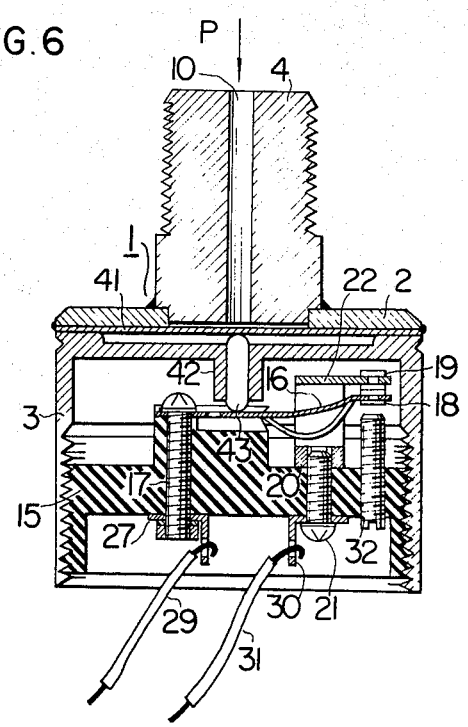
FIG. 6 is an elevational sectional view showing the pressure responsive switch of still another embodiment of the invention.

With reference to the embodiment of FIG. 6, the pressure applied member 41 is made in a form of a flat circular diaphragm welded between the hollow case 3 and the covering 2. The hollow case 3 is provided with a guide 42 for the contact rod 43 of an insulating material which transmits the displacement of the diaphragm 41 to the snap spring member 16. Upon application of the pressure P through the pressure introducing hole 10 to the diaphragm 41, the displacement thereof is imparted to the snap spring member 16 through the contact rod 43, with the result that the movable contact 18 snaps to come into contact with the OFF contact 32. The operation of the other components or elements are the same as that of the embodiment of FIG. 1 and so will not be mentioned.

As will be understood from the foregoing description, the pressure responsive switch according to the present invention has switch means taking advantage of snap action as well as a snap spring member with a higher compressive force with an advantage in that a larger current can be turned on and off when compared with the conventional switch of this type. Also, the fact that the pressure applied member performs no snap action results in a lower plastic strain of the pressure applied member for a higher yield rate. Further, the ease with which the response is set for switching operation and the capability of the adjustment of differential enables production of a low-cost pressure responsive switch with a simple construction. Furthermore, since no snap action is employed in the pressure applied member, the stress of the pressure applied member can be reduced, thus eliminating the problem of short life thereof. In addition, the pressure applied member of the pressure responsive switch according to the invention has such a long life as to endure 100 thousand to 200 thousand operations.

A safety device of a car cooler to which the pressure responsive switch according to the present invention is applied will be described below with reference to FIG. 7.

Figure 7:
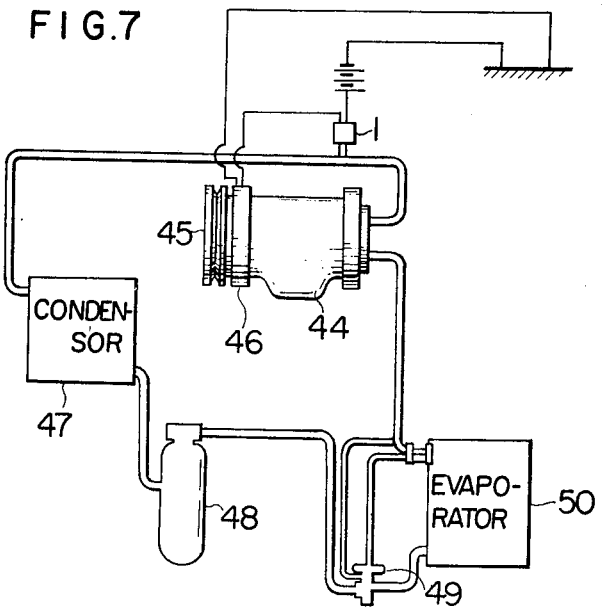
FIG. 7 is a diagram showing a system in which the pressure responsive switch according to the invention is applied to a car cooler.

Referring to FIG. 7, the rotation of the engine is transmitted to the compressor 44 through the V-shaped pulley 45 and the magnet clutch 46. The rotation of the compressor 44 causes a high-pressure gas refrigerant to be sent to a condenser 47 to be coverted into a high-pressure liquid refrigerant. Through a liquid tank 48 this high-pressure liquid refrigerant reaches the expansion valve 49 where it is converted into a low pressure liquid refrigerant and sent to an evaporator 50. The low pressure liquid refrigerant introduced into the evaporator 50 exchanges heat with air and is transformed into a low pressure gas refrigerant to be sent to the compressor 44, thus completing a refrigerating cycle of the car cooler.

The pressure responsive switch 1 according to the invention is provided at the outlet side of the compressor 44 and electrically connected to the magnet clutch 46 through a relay switch or the like not shown in the drawing. When the output pressure of the compressor 44 is abnormally increased, the pressure of the high-pressure gas refrigerant is applied to the pressure applied member 13 of the pressure responsive switch 1 and the resulting displacement of the pressure applied member 13 is transmitted to the snap spring member 16 thereby to deenergize the magnet switch 46. As a result, the rotation of the engine is prevented from being transmitted to the compressor 44, thereby preventing the output pressure of the compressor 44 from rising to an abnormally high level.

In addition, the pressure responsive switch according to the present invention may be applied with equal effect to a compressor or the like power source for construction machines such as a rock drill and to safety devices and annunciators used with chemical plants, etc.

What is claimed is:

1. In a pressure system of the type including first means for varying pressure of a fluid and second means for activating said first means, a pressure responsive switch means for controlling said second means, the improvement wherein said pressure responsive switch means comprises:

a hollow casing;

a switch body threadedly supported within said hollow casing;

snap spring means including a spring member having a first end secured to said switch body and a second movable end, a movable contact secured to said second movable end, and means for effecting snap action of said spring member such that said movable contact is selectively moved between first and second positions;

an ON contact and an OFF contact disposed respectively at said first and second positions such that said movable contact is selectively moved to be in contact with said ON contact and said OFF contact respectively;

pressure responsive means for transmitting a predetermined applied pressure to a predetermined portion of said spring member to actuate said means for effecting snap action; and means for adjusting said predetermined applied pressure be variation of the positional relationship between said hollow casing and said switch body threadedly supported therein.

2. A pressure responsive switch means according to claim 1, wherein said pressure responsive means includes a pressure applying member being displaceable in response to pressure and displacement amplifying means rotatably mounted in said switch body for transmitting an amplified displacement of said pressure applying member to said predetermined portion of said spring member.

3. A pressure responsive switch according to claim 1, wherein said means for adjusting acts independently of said pressure responsive means for transmitting said predetermined pressure to said spring member.

4. A pressure responsive switch according to claim 1, wherein said means for adjusting by variation of the positional relationship between said hollow casing and said switch body is provided by screwing displacement of said switch body with respect to said hollow casing.

5. A pressure responsive switch comprising:

a hollow casing;

a switch body threadedly supported within said hollow casing;

snap spring means including a spring member having a first end secured to said switch body and a second movable end, a movable contact secured to said second movable end, and means for effecting snap action of said spring member such that said movable contact is selectively moved between first and second positions;

an ON contact and an OFF contact disposed respectively at said first and second positions such that said movable contact is selectively moved to be in contact with said ON contact and said OFF contact respectively;

pressure responsive means for transmitting a predetermined applied pressure to a predetermined portion of said spring member to actuate said means for effecting snap action; and means for adjusting said predetermined applied pressure by variation of the positional relationship between said hollow casing and said switch body threadedly supported therein.

6. A pressure responsive switch according to claim 6, wherein said means for adjusting acts independently of said pressure responsive means for transmitting said predetermined pressure to said spring member.

7. A pressure responsive switch according to claim 5, wherein said ON contact is supported by a supporting member fixed in said switch body.

8. A pressure responsive switch according to claim 7, wherein said ON and OFF contacts are axially aligned with a gap therebetween, and wherein said movable contact is movably disposed in said gap between said ON and OFF contacts.

9. A pressure responsive switch according to claim 8, wherein one of said ON and OFF contacts is adjustable such that said gap is variable.

10. A pressure responsive switch according to claim 9, wherein said OFF contact is adjustable.

11. A pressure responsive switch according to claim 5, wherein said OFF contact is threadedly mounted on said switch body.

12. A pressure responsive switch according to claim 5, wherein said means for adjusting by variation of the positional relationship between said hollow casing and said switch body is provided by screwing displacement of said switch body with respect to said hollow casing.

13. A pressure responsive switch according to claim 5, wherein said spring member is a metallic plate strip.

14. A pressure responsive switch according to claim 5, wherein said pressure responsive means includes means for amplifying the transmitted predetermined applied pressure to said spring member.

15. A pressure responsive switch comprising:

a switch base screwed into a hollow case and supported therein, a snap spring member fixed on part of said switch base for performing snap action, a movable contact fixed on part of said snap spring member, an ON contact and an OFF contact adapted to be brought into contact with and detached from said movable contact, a pressure applied member on said hollow case which is displaced in response to pressure applied thereto, wherein a supporting member is fixed on said switch base, a displacement amplifying member is swingably supported on said supporting member around a supporting shaft, the displacement of said pressure applied member is transmitted to a portion of said displacement amplifying member, a contact rod made of an insulating material is disposed on said displacement amplifying member in spaced relationship with said portion of said displacement amplifying member to which the displacement of said pressure applied member is transmitted, and the displacement of said pressure applied member is amplified and transmitted to said snap spring member by bringing said contact rod into contact with said snap spring member, so that said movable contact is brought into contact with and detached from said ON and OFF contacts, and means for adjusting the operating pressure of said snap spring member by changing the positional relationship between said switch base and said hollow case.

16. A pressure responsive switch according to claim 15, wherein said means for adjusting acts independently of said displacement amplifying member.

17. A pressure responsive switch according to claim 15, wherein said ON contact is also supported by said supporting member.

18. A pressure responsive switch according to claim 17, wherein said ON and OFF contacts are arranged coaxially with a gap therebetween, and wherein said movable contact is positioned within said gap between said ON and OFF contacts, said movable contact selectively contacting said ON and OFF contacts.

19. A pressure responsive switch according to claim 18, wherein one of said ON and OFF contacts is adjustable such that said gap is variable.

20. A pressure responsive switch according to claim 15, wherein said displacement amplifying member is a plate member having a first end supported on said supporting member and a second end supporting said contact rod.

21. A pressure responsive switch according to claim 20, wherein said portion of said displacement amplifying member to which the displacement of said pressure member is transmitted is approximately at the center of said plate member.

22. A pressure responsive switch according to claim 20, wherein said first and second ends are opposite ends of said plate member.

23. A pressure responsive switch according to claim 15, wherein said pressure applied member includes a protrusion, and said displacement amplifying member includes a recess, said protrusion engaging said recess for providing a contact point at which said displacement of said pressure applied member is transmitted to said displacement amplifying member.

* * * * *